United States Patent [19]

Troughton et al.

[11] Patent Number: 4,921,116

[45] Date of Patent: May 1, 1990

[54] STEEL DRUM

[75] Inventors: Thomas D. Troughton, Richmond; Robert D. Irwin, San Rafael, both of Calif.

[73] Assignee: Pacific Rim Packaging Corporation, Richmond, Calif.

[21] Appl. No.: 243,854

[22] Filed: Sep. 13, 1988

[51] Int. Cl.[5] ..... B65D 3/04

[52] U.S. Cl. ..... 220/72; 72/367; 220/83; 413/1

[58] Field of Search ..... 72/365, 367, 369; 220/5 R, 72, 83; 413/1

[56] References Cited

U.S. PATENT DOCUMENTS

| | | | |
|---|---|---|---|
| 1,134,730 | 4/1915 | Draper | 220/72 |
| 1,402,830 | 1/1922 | Boyle, Sr. | 220/72 |
| 3,357,593 | 12/1967 | Sears, Jr. et al. | 220/72 |
| 3,389,839 | 6/1975 | Simon et al. | 220/72 |
| 4,257,527 | 3/1981 | Snyder | 220/72 |

FOREIGN PATENT DOCUMENTS

| | | | |
|---|---|---|---|
| 0636411 | 2/1962 | Canada | 220/72 |
| 0809723 | 3/1959 | United Kingdom | 220/72 |

*Primary Examiner*—Jimmy G. Foster

*Attorney, Agent, or Firm*—Flehr, Hohbach, Test, Albritton & Herbert

[57] ABSTRACT

A high strength metallic drum is disclosed having an high internal volume for given external dimensions. The drum is divided into annular top, middle and bottom drum sections. Each drum section has a constant diameter, with the diameters of the top and bottom drum sections being larger than the diameters of the middle drum section. A pair of swedge rolling hoops are provided at the boundaries between adjacent sections to give the drum rigidity. A first one of the rolling hoops joins the top and middle sections while the second rolling hoop joins the middle and bottom sections. Each swedge rolling hoop has a gripping surface that extends outwardly from the middle drum portion to facilitate handling the drum. The maximum diameters of the swedge rolling hoops are larger than the diameters of each of the sections they join. In a preferred 55 gallon drum embodiment, the top and bottom sections have the same diameter and the swedge rolling hoops are mirror images of each other. The maximum diameter of the swedge rolling hoops are in the range of three quarters of an inch to one inch greater than the diameter of the middle drum section.

7 Claims, 3 Drawing Sheets

STEEL DRUM

The present invention relates generally to an improved steel drum construction. More particularly, a compact 55 gallon drum construction is disclosed that maximizes internal volume while minimizing external diameter and retaining compatibility with conventional material handling devices.

BACKGROUND OF THE INVENTION

Conventional 55 gallon drums do not fit well within ISO type ocean shipping containers. Specifically, the internal dimensions of ISO containers are approximately 91 ¾ inches by 232 ¼ inches. Since standard 55 gallon drums are 23 7/16 inches in diameter at their rolling hoops, the drums cannot quite fit four abreast or ten in a row within the ISO containers. Similarly, not quite ten aligned rows can be fitted into an ISO container. Therefore, as can be seen by the loading configuration shown in FIG. 4, a maximum of 76 normal 55 gallon drums can be placed into an ISO container when loaded in unpalletized form (the drums are typically stacked two high). When loaded on pallets, only 72 drums will fit within a container. Since this is clearly a waste of valuable cargo space, there have been various attempts by drum makers around the world to economically manufacture 55 gallon steel drums having dimensions suitable for fitting snugly into ISO containers.

Attempts to merely proportionally narrow the drums and compensate by making the drums taller are unsuitable since the additional height requirements make the drums to tall for many other applications. In addition, narrow and taller drums do not adapt to standarized materials handling and conveying systems. Simply eliminating the expanded rolling hoops is also unacceptable since tubular drums do not have sufficient sidewall strength to sustain the abuse of normal use. Therefore, some manufacturers have attempted to strengthen the sidewalls using corrugations and/or inward beads. However, such designs to not provide sufficient rigidity and resistance to implosion of the drum body by internal vacuums resulting from hot-filling the drum and its subsequent cooling in a sealed condition. Further, rolling hoops are needed to facilitate handling of the drums with conventional drum grippers. Therefore, there is a need for a drum construction that maximizes volume for a given external diameter yet maintains rolling hoops to facilitate handling by drum grippers and to strengthen the drum sidewall through the rigidizing effects of the expanding action.

SUMMARY OF THE INVENTION

Accordingly, it is a primary objective of the invention to provide a drum with rolling hoops having an increased internal volume for given outer dimensions.

Another objective of the invention is to provide a drum that may be readily made with conventional expander equipment.

Another specific objective of the invention is to provide a 55 gallon drum construction having the maximum diameter suitable for fitting 4-across in an ISO container to facilitate loading 80 drums per ISO-container.

Another objective of the invention is to provide a drum construction that maintains the expanded rolling hoops at the traditional locations in the body of the drum to facilitate handling of the drums with conventional drum grippers and the like.

To achieve the foregoing and other objects and in accordance with the purpose of the present invention, a metallic drum is provided having an annular top, middle and bottom drum sections. The diameters of the top and bottom drum sections are larger than the diameters of the middle drum section. A pair of swedged rolling hoops are provided to give the drum rigidity. A first one of the rolling hoops joins the top and middle sections while the second rolling hoop joins the middle and bottom sections. Each swedge rolling hoop has a gripping surface that extends outwardly from the middle drum portion to facilitate handling the drum. The maximum diameters of the swedge rolling hoops are larger than the diameters of each of the sections they join.

In a preferred embodiment, the top and bottom sections have the same diameter and the swedge rolling hoops are mirror images of each other. In another preferred embodiment, the drum is a 55 gallon drum and the maximum diameter of the swedge rolling hoops are in the range of three quarters of an inch to one inch greater than the diameter of the middle drum section.

In a method aspect of the invention, a steel sheet is rolled into a tubular configuration and welded to form a cylinder having a uniform first diameter and open top and bottom ends. A top portion of the drum adjacent the top end is expanded to create a top drum portion having a diameter that is greater than the first diameter. A bottom portion of the drum adjacent the bottom end is expanded to create a bottom drum portion having a diameter that is greater than the first diameter. The region between the top and bottom drum portions forms a middle drum portion having a diameter that is less than the top and bottom portions. The boundary between the top and middle drum portions and the boundary between the middle and bottom drum portions are further expanded to create first and second rolling hoops at the respective boundaries.

BRIEF DESCRIPTION OF THE DRAWINGS

The features of the present invention that are believed to be novel are set forth with particularity in the appended claims. The invention, together with further objects and advantages thereof, may best be understood by reference to the following description taken in conjunction with the accompanying drawings in which:

DETAILED DESCRIPTION OF THE DRAWINGS

Figure 1:
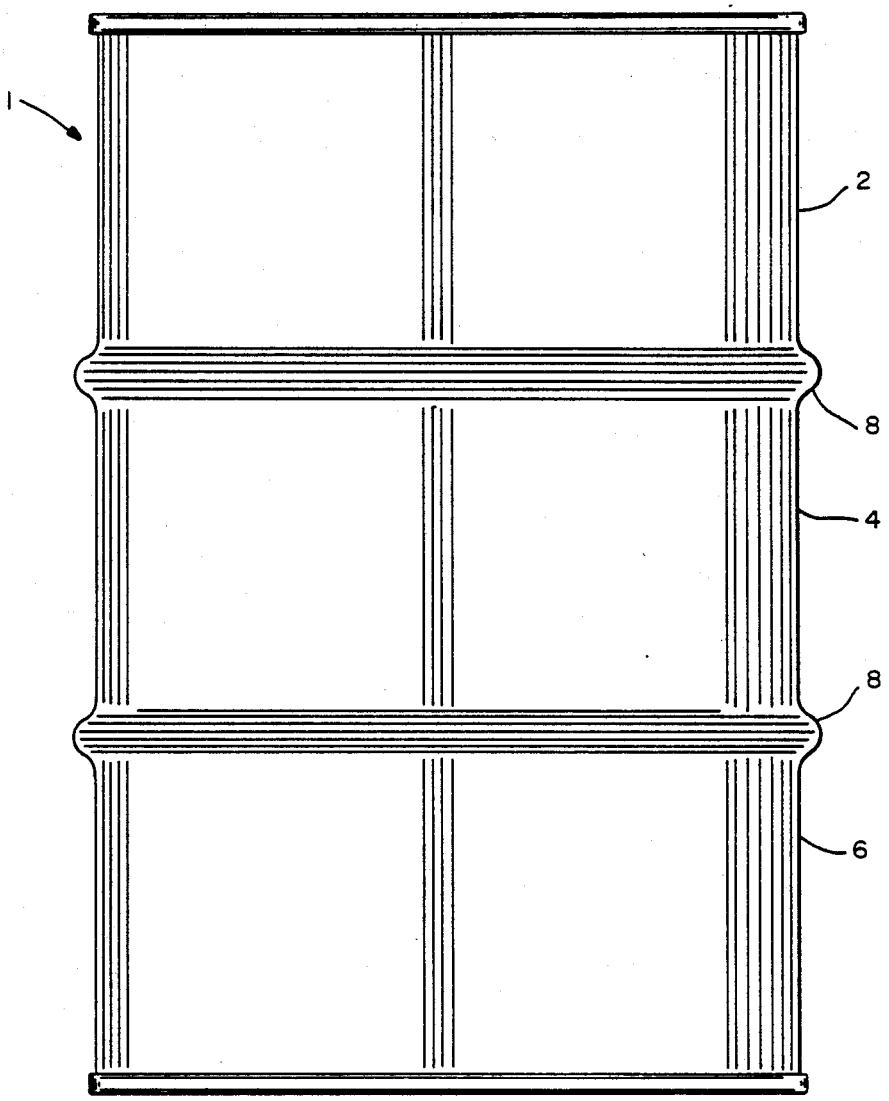
( PRIOR ART ) FIG.— 1
FIG. 1 is a diagrammatic side view of a prior art 55 gallon drum.

As illustrated in the drawings, the present invention relates to an improved steel drum construction. The embodiment of the invention chosen for the purposes of illustration is that of a 55 gallon drum having dimensions suitable for loading four abreast in conventional ISO ocean shipping containers. However, it should be appreciated that the construction described may be applied to drums having a wide variety of dimensions.

Referring first to FIG. 1, conventional 55 gallon drums include top, middle and bottom sections (2,4 and 6 respectively) having the same diameter with expanded rolling hoops 8 disposed between adjacent sections to provide rigidity and to facilitate handling with conventional drum gripping devices.

Figure 2:
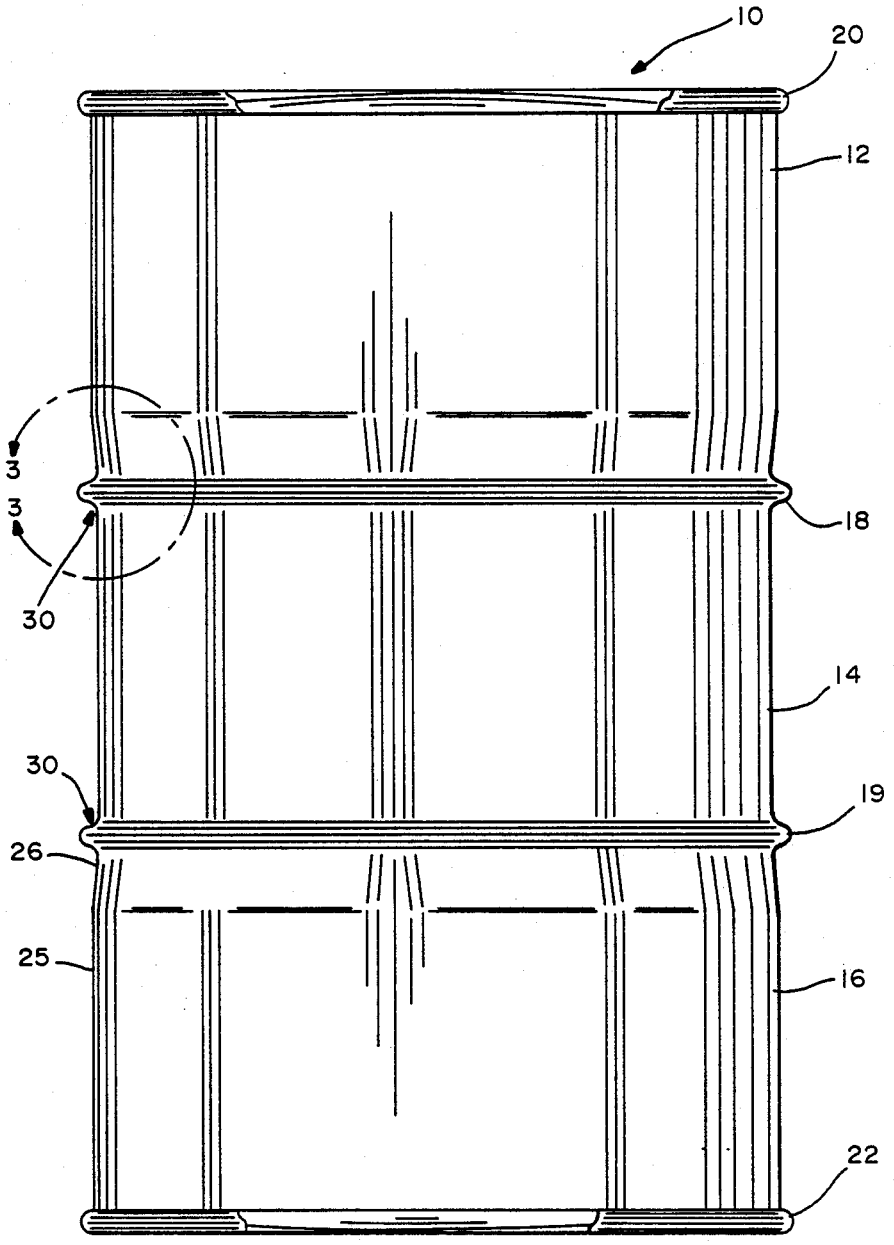
FIG. 2 is a diagrammatic side view of a drum constructed in accordance with the present invention.
Figure 3:
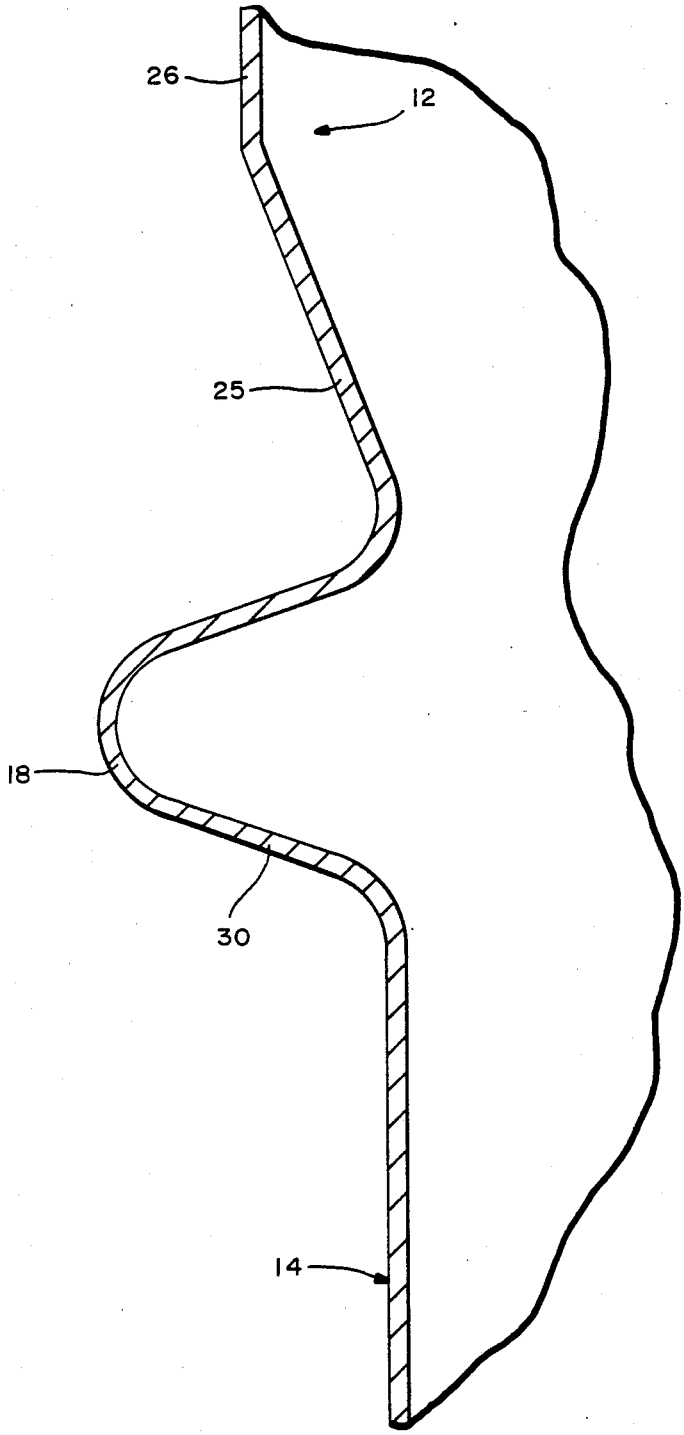
FIG. 3 is an enlarged view of the region marked FIG. 3 in FIG. 2 which details the contour of the drum in the vicinity of a rolling hoop.

Referring next to FIG. 2, the improvements of the present invention will be described. A drum 10 built in accordance with the present invention includes a top section 12, a middle section 14, a bottom section 16 a pair of rolling hoops 18,19, top cover 20 and bottom cover 22.

Rolling hoop 18 forms the boundary between top sections 12 and middle section 14, while rolling hoop 19 forms the boundary between middle section 14 and bottom section 16. The top and bottom sections 12,16 are mirror images of one another and each include a substantially annular outer portion 25 and a slightly tapered inner portion 26 that tapers inward towards their associated rolling hoops as can be readily seen by reference to FIG. 2. The middle section 14 is annular and has a diameter that is less than the diameter of the annular outer portions 25 of the top and bottom section In the embodiment of the invention chosen for the purpose of illustration, the tapered inner portions 26 define a gradual constriction from the diameter of the outer portions 25 to the diameter of the middle section 14.

The rolling hoops 18, 19 are formed with a conventional swedger expander to give the drum high rigidity and to provide resistance to implosion of the drum body such as is known to occur in non-reinforced drums when the drums are subjected to an internal vacuum as may occur when the drums are hot filled and subsequently cooled while sealed. The rolling hoops extend outwardly from the middle section 14 to form gripping surfaces 30 to facilitate handling of the drum with conventional drum grippers. The maximum diameter of the rolling hoops is less than the diameter of the outer portions 20 and 22 (top and bottom seams) of the top and bottom drum sections. Preferably, the relative diameters of the rolling hoops and the outer portions 25 of the top and bottom drum sections are chosen such that when the top and bottom covers 20,22 are attached using conventional seaming techniques, the diameter of the rolling hoops will substantially equal the diameter of the top and bottom covers, which typically slightly exceed the diameter of the adjacent portion of the drum body.

The actual diameter of the annular outer portions of the top and bottom sections may be adjusted to facilitate particular drum cover attachment schemes. Alternatively, the outer portions of the drums may be expanded to a predetermined smaller diameter at both ends of the drum in order to accommodate a triple seam cover attachment construction without increasing the overall diameter of the finished drum.

In a preferred embodiment of the invention chosen for the purposes of illustration, the drum takes the form of a 55 gallon drum. The maximum diameter of the top and bottom covers and/or the rolling hoops is 22⅞". The diameter of the middle section 14 is 22", while the diameter of the annular outer portions 25 of top and bottom sections 12,16 are 22½". The rolling hoops 18,19 have a height of approximately 27/64"above the middle section 16. The overall height of the drum is approximately 35¼", which includes approximately 11 inches between rolling hoop centers. The rolling hoops have an outer radius of curvature of approximately 17/64". The tapered inner portions 26 of the top and bottom sections encompass approximately 2 inches adjacent the outer edge of the rolling hoop. The annular outer portions 25 of the top and bottom sections 12,16 are approximately 9⅝'. Suitably sized top and bottom covers 20,22 are used to seal the container. A pair of threaded openings are provided in the top cover to provide access to the drum. The openings are of conventional size for 55 gallon drums and are placed on centers within a tolerance range of 17¼"to 17¼".

Figure 4:
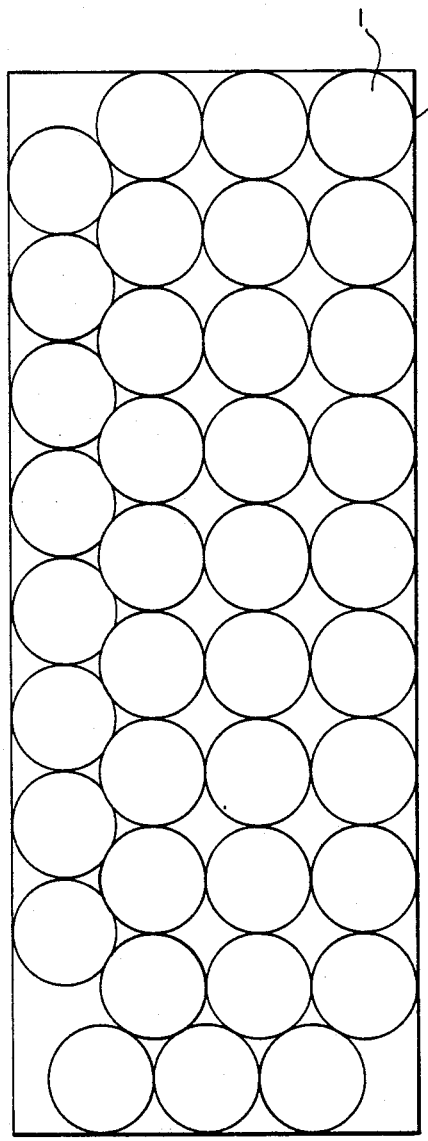
FIG. 4 is a diagrammatic top view of an ISO shipping container loaded with conventional 55 gallon drums.
Figure 5:
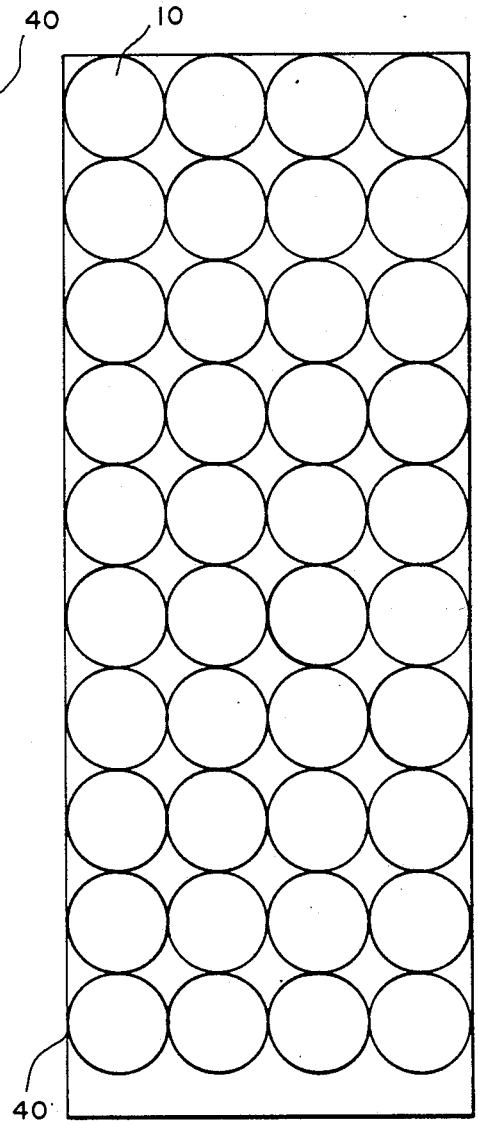
FIG. 5 is a diagrammatic top view of an ISO shipping container loaded with 55 gallon drums constructed in accordance with the present invention.

Referring next to FIGS. 4 and 5, one of the benefits of 55 gallon drums constructed to the above cited dimensions will be apparent. As indicated in the background section above, standard ISO shipping containers are not quite wide enough (91-¾") to hold standard 55 gallon drums (having a maximum diameter of 23-7/16 inches in the rolling hoops) four abreast. Similarly, the ISO containers are not quite long enough (232¼") to hold 10 rows of aligned conventional drums. Therefore, with the optimal unpalletized drum stacking arrangement as shown in FIG. 4, only 76 drums can be placed in an ISO container, since the drums are traditionally stacked two high. With the reduced dimensions discussed above that are made possible using the expanded drum construction of the present invention, the drums may be placed four abreast in ten aligned rows which allows the storage of 80 drums within an ISO container, as shown in FIG. 5. This is quite important in practice since the costs of shipping drums is very often tied to the floor space that the drums occupy.

In a method aspect of the invention, a steel drum is fabricated by rolling a steel sheet into a tubular configuration and welding the sheet to form a cylinder having a uniform diameter. The ends of the drums are open at this point. The expanding mechanism for a drum body expanding machine is placed into one of the open ends of the drum and expanded to stretch a first end of the drum to the desired diameter. The same process is then repeated for the opposite end of the drum. It should be appreciated that the expanding steps may occur simultaneously as well. Once the drum body has been suitably expanded, a swedge expander is utilized to create rolling hoops at the boundaries between the expanded and nonexpanded sections of the drum. Top and bottom covers are then seamed to the tubular drum body using conventional techniques to complete the drum. The completed drum may then be cleaned, coated and/or painted as necessary to suit a particular purpose using standard techniques.

Although only a few embodiments of the present invention have been described herein, it should be understood that the present invention may be embodied in many other specific forms without departing from the spirit or scope of the invention. Particularly, it should be appreciated that the actual dimensions of the drum may be widely varied to suit particular needs. Further, the tapered portion of the top and bottom sections may be eliminated to provide a drum having two constant diameter outer sections and a smaller diameter middle section. With such a design, the rolling hood itself would form the transition between the outer and inner sections Additionally, the method of constructing the drum disclosed herein may be widely varied without departing from the scope of the invention. Therefore, the present examples and embodiments are to be considered as illustrative and not restrictive, and the invention is not to be limited to the details given herein, but may be modified within the scope of the appended claims.

I claim:

1. A metallic drum having an annular middle drum section having a first diameter, an expanded annular top drum section having a second diameter that is larger than said first diameter, an expanded annular bottom drum section having a third diameter that is larger than said first diameter, a first and a second annular rolling hoop for providing drum rigidity and resistance to implosion, wherein said first rolling hoop joins said top drum section to said middle drum section, and said second rolling hoop joins said bottom drum section to said middle drum section, each said rolling hoop having a gripping surface that extends outwardly from the middle drum section to facilitate handling of the drum, the maximum diameter of the gripping surface of said first rolling hoop being larger than said second diameter and the maximum diameter of the gripping surface of said second rolling hoop being larger than said third diameter.

2. A drum as recited in claim 1 wherein said second diameter is substantially equal to said third diameter and wherein said first and second rolling hoops are mirror images of one another.

3. A drum as recited in claim 2 wherein said top and bottom sections each include substantially annular outer portions and tapered inner portions that taper inward towards the rolling hoops.

4. A drum as recited in claim 3 wherein said middle section has a substantially constant diameter.

5. A drum as recited in claim 4 wherein the maximum diameter of said rolling hoops is in the range of three quarters of an inch to one inch greater than the diameter of said middle drum portion.

6. A drum as recited in claim 5 wherein said drum is a 55 gallon drum.

7. A method of fabricating a steel drum comprising the steps of:

rolling a steel sheet into a tubular configuration and welding the sheet to form a cylinder having a uniform first diameter, a first open end and a second open end;

expanding a top portion of the drum adjacent the first open end to create a top drum section having a second diameter that is greater than said first diameter;

expanding a bottom portion of the drum adjacent the second open end to create a bottom drum section having a third diameter that is greater than said first diameter, wherein the region between said top and bottom drum portions forms a middle drum section having a diameter equal to said first diameter;

expanding the boundary between said top and middle drum sections to form a first rolling hoop;

expanding the boundary between said bottom and middle drum sections to form a second rolling hoop.

* * * * *